US008991196B2

(12) United States Patent
Xu

(10) Patent No.: US 8,991,196 B2
(45) Date of Patent: Mar. 31, 2015

(54) REGENERATOR, GM REFRIGERATOR, AND PULSE TUBE REFRIGERATOR

(75) Inventor: Mingyao Xu, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 131 days.

(21) Appl. No.: 13/603,690

(22) Filed: Sep. 5, 2012

(65) Prior Publication Data

US 2013/0000326 A1 Jan. 3, 2013

Related U.S. Application Data

(63) Continuation of application No. PCT/JP2011/056045, filed on Mar. 15, 2011.

(30) Foreign Application Priority Data

Mar. 19, 2010 (JP) ..... 2010-065037

(51) Int. Cl.
*F25B 9/00* (2006.01)

(52) U.S. Cl.
CPC ..... *F25B 9/00* (2013.01)
USPC ..... 62/6; 62/51.1

(58) Field of Classification Search
CPC . F25B 9/14; F25B 2309/001; F25B 2309/003
USPC ..... 62/6, 51.1
See application file for complete search history.

(56) References Cited

U.S. PATENT DOCUMENTS

| | | | | |
|---|---|---|---|---|
| 5,609,034 | A * | 3/1997 | Mita et al. | 62/6 |
| 6,256,998 | B1 | 7/2001 | Gao | |
| 2005/0198974 | A1 * | 9/2005 | Roth | 62/51.1 |
| 2008/0276626 | A1 * | 11/2008 | Xu | 62/6 |

FOREIGN PATENT DOCUMENTS

| | | | |
|---|---|---|---|
| JP | 58-040456 | | 3/1983 |
| JP | 60-023761 | | 2/1985 |
| JP | 2650437 | | 9/1997 |
| JP | 11-37582 | * | 2/1999 |
| JP | 11-037582 | | 2/1999 |
| JP | 2003-532045 | | 10/2003 |

OTHER PUBLICATIONS

International Search Report mailed on Jun. 28, 2011.

* cited by examiner

*Primary Examiner* — Frantz Jules
*Assistant Examiner* — Erik Mendoza-Wilkenfel
(74) *Attorney, Agent, or Firm* — IPUSA, PLLC

(57) ABSTRACT

A helium-cooling type regenerator configured to retain cold temperatures of working gas includes a first section through which the working gas flows, a second section configured to accommodate helium gas as a regenerator material, and a regenerator material pipe connected to the second section and to a helium source.

6 Claims, 8 Drawing Sheets

REGENERATOR, GM REFRIGERATOR, AND PULSE TUBE REFRIGERATOR

CROSS-REFERENCE TO RELATED APPLICATIONS

This application is a continuation application filed under 35 U.S.C. 111(a) claiming benefit under 35 U.S.C. 120 and 365(c) of International Application PCT/JP2011/056045, filed on Mar. 15, 2011, and designated the U.S., which claims priority to Japanese Patent Application No. 2010-065037, filed on Mar. 19, 2010. The entire contents of the foregoing applications are incorporated herein by reference.

BACKGROUND OF THE INVENTION

1. Field of the Invention

The present invention relates generally to regenerators, and more particularly to a regenerator usable in regenerative refrigerators and to regenerative refrigerators using the regenerator.

2. Description of the Related Art

Regenerative refrigerators such as Gifford-McMahon (GM) refrigerators and pulse tube refrigerators are capable of producing cold temperatures from low temperatures of approximately 100 K (kelvin) to cryogenic temperatures of approximately 4 K, and may be used for cooling superconducting magnets and detectors and in cryopumps.

For example, in GM refrigerators, working gas such as helium gas compressed in a compressor is introduced into a regenerator to be pre-cooled by a regenerator material in the regenerator. Further, after producing cold temperatures corresponding to work of expansion in an expansion chamber, the working gas again passes through the regenerator to return to the compressor. At this point, the working gas passes through the regenerator while cooling the regenerator material in the regenerator for working gas to be introduced next. Cold temperatures are periodically produced based on this process as one cycle.

In such regenerative refrigerators, a magnetic material such as $HoCu_2$ is used as the regenerator material of the regenerator as described above in the case of producing cryogenic temperatures lower than 30 K.

Further, lately, studies have been made of using helium gas as a regenerator material of regenerators. Such regenerators are also referred to as helium-cooling type regenerators. For example, Japanese Laid-Open Patent Application No. 11-37582 illustrates using multiple thermally conductive capsules filled with helium gas as a regenerator material for a regenerator.

FIG. 1 is a graph illustrating changes in the specific heat of helium gas and the specific heat of a $HoCu_2$ magnetic material relative to temperature. FIG. 1 clearly illustrates that at cryogenic temperatures around approximately 10 K, the specific heat of helium gas of a pressure of approximately 1.5 MPa is higher than the specific heat of the $HoCu_2$ magnetic material. Accordingly, in such a temperature range, using helium gas in place of the $HoCu_2$ magnetic material makes it possible to perform heat exchange more efficiently.

Practically, however, it is not easy to manufacture the capsule as illustrated in Japanese Laid-Open Patent Application No. 11-37582. For example, a pressure of approximately 160 MPa at room temperature is necessary in order for the helium gas in the capsule to have a pressure of approximately 1.5 MPa. A capsule filled with such high-pressure helium cannot be easily manufactured. Further, the formation of such a capsule resistant to high pressure inevitably results in an increase in the thickness of the capsule, thus reducing its thermal conductivity.

Therefore, lately, there has been a report of a helium-cooling type regenerator configured by providing multiple containers with holes inside the regenerator and causing helium gas used as the working gas of an apparatus to flow through the containers through the holes. (See Japanese Patent No. 2650437.)

SUMMARY OF THE INVENTION

According to an aspect of the present invention, a helium-cooling type regenerator configured to retain cold temperatures of working gas includes a first section through which the working gas flows; a second section configured to accommodate helium gas as a regenerator material; and a regenerator material pipe connected to the second section and to a helium source.

According to an aspect of the present invention, a Gifford-McMahon refrigerator includes the helium-cooling type regenerator as set forth above; and a compressor configured to feed the working gas to an expansion chamber via the helium-cooling type regenerator and to collect the working gas from the expansion chamber via the helium-cooling type regenerator, wherein the regenerator material pipe is connected to the compressor as the helium source.

According to an aspect of the present invention, a pulse tube refrigerator includes the helium-cooling type regenerator as set forth above; and a compressor configured to feed the working gas to a pulse tube via a regenerator tube and to collect the working gas from the pulse tube via the regenerator tube, wherein the helium-cooling type regenerator is provided in the regenerator tube, and the regenerator material pipe is connected to the compressor as the helium source.

According to an aspect of the present invention, a pulse tube refrigerator includes the helium-cooling type regenerator as set forth above; a compressor configured to feed the working gas to a pulse tube via a regenerator tube and to collect the working gas from the pulse tube via the regenerator tube; and a buffer tank connected to the pulse tube, wherein the helium-cooling type regenerator is provided in the regenerator tube, and the regenerator material pipe is connected to the buffer tank as the helium source.

The object and advantages of the embodiments will be realized and attained by means of the elements and combinations particularly pointed out in the claims.

It is to be understood that both the foregoing general description and the following detailed description are exemplary and explanatory and not restrictive of the invention.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

According to the above-described helium-cooling type regenerator of Japanese Patent No. 2650437, the regenerator is implemented by helium gas, also serving as working gas, flowing into and out of the containers through the holes formed in the containers. However, when such inflow and outflow of helium gas into and from the containers frequently occurs, a variation in the pressure of helium gas working as a regenerator material in the containers increases. Further, this destabilizes the temperature of helium gas, which is a regenerator material, thus making it difficult for the regenerator to maintain stable regeneration performance.

According to an aspect of the present invention, a helium-cooling type regenerator is provided that is capable of maintaining regeneration performance more stably than those of the conventional system, and a refrigerator is provided that includes the regenerator.

First, for a better understanding of embodiments of the present invention, a description is given of a common regenerative refrigerator including a helium-cooling type regenerator.

Figure 1:
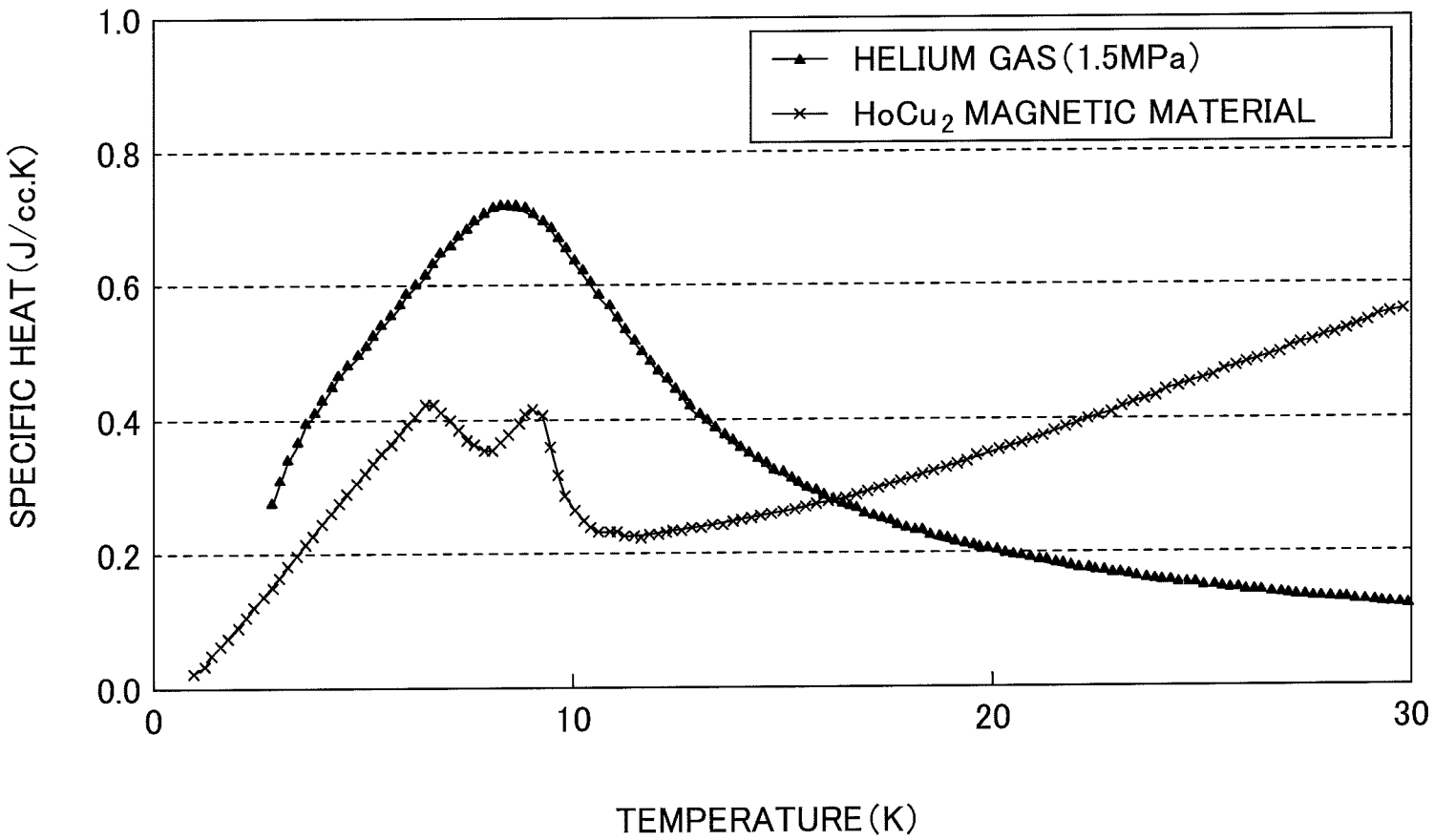
FIG.1 RELATED ART
FIG. 1 is a graph illustrating changes in the specific heat of helium gas and the specific heat of a $HoCu_2$ magnetic material relative to temperature.
Figure 2:
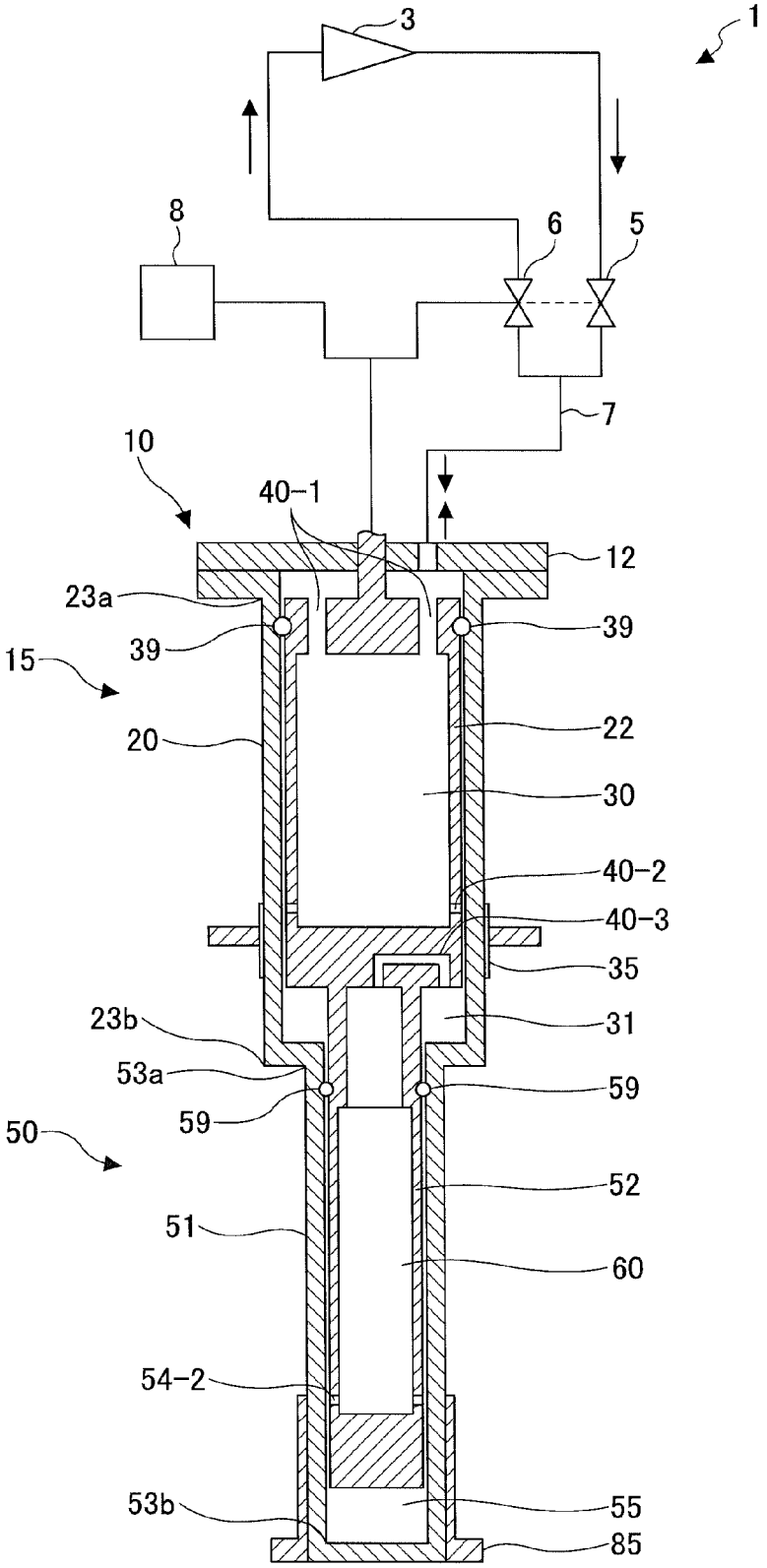
FIG.2 RELATED ART
FIG. 2 is a schematic diagram illustrating a configuration of a common Gifford-McMahon (GM) refrigerator.

FIG. 2 is a schematic diagram illustrating a GM refrigerator as an example of the regenerative refrigerator.

Referring to FIG. 2, a GM refrigerator 1 includes a gas compressor 3 and a two-stage cold head 10 that operates as a refrigerator. The cold head 10 includes a first-stage cooling part 15 and a second-stage cooling part 50. These cooling parts 15 and 50 are so connected to a flange 12 to be concentric with each other.

The first-stage cooling part 15 includes a hollow first-stage cylinder 20, a first-stage displacer 22, a first-stage regenerator 30, a first-stage expansion chamber 31, and a first-stage cooling stage 35. The first-stage displacer 22 is so provided in the first-stage cylinder 20 as to be reciprocatable in axial directions. The first-stage regenerator 30 fills in the first-stage displacer 22. The first-stage expansion chamber 31 is provided inside the first-stage cylinder 20 on the side of a low-temperature end 23*b*. The volume of the first-stage expansion chamber 31 changes as the first-stage displacer 22 reciprocates. The first-stage cooling stage 35 is provided on the first-stage cylinder 20 near its low-temperature end 23*b*. A first-stage seal 39 is provided between the inner wall surface of the first-stage cylinder 20 and the outer wall surface of the first-stage displacer 22.

Multiple first-stage high-temperature-side flow passages 40-1 are formed in the first-stage displacer 22 on the side of a high-temperature end 23*a* of the first-stage cylinder 20 so as to allow helium gas to flow into and out of the first-stage regenerator 30. Further, multiple first-stage low-temperature-side flow passages 40-2 are formed in the first-stage displacer 22 on the side of the low-temperature end 23*b* of the first-stage cylinder 20 so as to allow helium gas to flow into and out of the first-stage regenerator 30 and the first-stage expansion chamber 31.

The second-stage cooling part 50 has substantially the same configuration as the first-stage cooling part 15. The second-stage cooling part 50 includes a hollow second-stage cylinder 51, a second-stage displacer 52, a second-stage regenerator 60, a second-stage expansion chamber 55, and a second-stage cooling stage 85. The second-stage displacer 52 is so provided in the second-stage cylinder 51 as to be reciprocatable in axial directions. The second-stage regenerator 60 fills in the second-stage displacer 52. The second-stage expansion chamber 55 is provided inside the second-stage cylinder 51 on the side of a low-temperature end 53*b*. The volume of the second-stage expansion chamber 55 changes as the second-stage displacer 52 reciprocates. The second-stage cooling stage 85 is provided on the second-stage cylinder 51 near its low-temperature end 53*b*. A second-stage seal 59 is provided between the inner wall surface of the second-stage cylinder 51 and the outer wall surface of the second-stage displacer 52.

A second-stage high-temperature-side flow passage 40-3 is formed in the second-stage displacer 52 on the side of a high-temperature end 53*a* of the second-stage cylinder 51 so as to allow helium gas to flow into and out of the second-stage regenerator 60. Further, multiple second-stage low-temperature-side flow passages 54-2 are formed in the second-stage displacer 52 on the side of the low-temperature end 53*b* of the second-stage cylinder 51 so as to allow helium gas to flow into and out of the second-stage expansion chamber 55.

In the GM refrigerator 1, high-pressure helium gas is fed from the gas compressor 3 to the first-stage cooling part 15 via a valve (intake valve) 5 and a pipe 7. Further, low-pressure helium gas is discharged from the first-stage cooling part 15 to the gas compressor 3 via the pipe 7 and a valve (exhaust valve) 6. The first-stage displacer 22 and the second-stage displacer 52 are caused to reciprocate by a drive motor 8. In conjunction with this reciprocation, the valve 5 and the valve 6 are opened and closed to control the timing of taking in and discharging helium gas.

The high-temperature end 23*a* of the first-stage cylinder 20 is, for example, at room temperature. The low-temperature end 23*b* of the first-stage cylinder 20 is, for example, at 20 K through 40 K. The high-temperature end 53*a* of the second-stage cylinder 51 is, for example, at 20 K through 40 K. The low-temperature end 53*b* of the second-stage cylinder 51 is, for example, at 4 K.

Next, a brief description is given of an operation of the GM refrigerator 1 of this configuration.

First, it is assumed that the first-stage displacer 22 and the second-stage displacer 52 are at their respective bottom dead ends inside the first-stage cylinder 20 and the second-stage cylinder 51 with the valve 5 and the valve 6 being closed.

In this state, opening the valve 5 with the valve 6 being closed causes high-pressure helium gas to flow from the gas compressor 3 into the first-stage cooling part 15. The high-pressure helium gas flows into the first-stage regenerator 30 through the first-stage high-temperature-side flow passages 40-1 to be cooled to a predetermined temperature by the regenerator material of the first-stage regenerator 30. The cooled helium gas flows into the first-stage expansion chamber 31 through the first-stage low-temperature-side flow passages 40-2.

Part of the high-pressure helium gas that has flown into the first-stage expansion chamber 31 flows into the second-stage regenerator 60 through the second-stage high-temperature-side flow passage 40-3. This helium gas is further cooled to a lower predetermined temperature by the regenerator material of the second-stage regenerator 60 to flow into the second-stage expansion chamber 55 through the second-stage low-temperature-side flow passages 54-2. As a result, the pressure increases inside the first-stage expansion chamber 31 and the second-stage expansion chamber 55.

Next, as the first-stage displacer 22 and the second-stage displacer 52 move to their respective top dead ends, the valve 5 is closed, and the valve 6 is opened. As a result, the helium gas inside the first-stage expansion chamber 31 and the second-stage expansion chamber 55 is reduced in pressure and increases in volume (expands), so that low temperatures are produced in the first-stage expansion chamber 31 and the second-stage expansion chamber 55. Further, this cools the first-stage cooling stage 35 and the second-stage cooling stage 85.

Next, the first-stage displacer 22 and the second-stage displacer 52 are caused to move toward their respective bottom dead ends. With this movement, the low-pressure helium gas travels back the above-described route to return to the gas compressor 3 through the valve 6 and the pipe 7 while cooling the first-stage regenerator 30 and the second-stage regenerator 60. Thereafter, the valve 6 is closed.

By employing the above-described operation as one cycle and repeatedly performing the above-described operation, in the first-stage cooling stage 35 and the second-stage cooling stage 85, it is possible to absorb heat from objects of cooling (not graphically illustrated) thermally coupled to the first-stage cooling stage 35 and the second-stage cooling stage 85, respectively, so that it is possible to cool the objects of cooling.

Here, for example, in the case of producing cryogenic temperatures lower than 30 K in the second-stage cooling stage 85, a magnetic material such as $HoCu_2$ is used as the regenerator material of the second-stage regenerator 60.

Further, lately, it has been proposed to use a so-called helium-cooling type regenerator that uses helium gas as the regenerator material of the regenerator.

Figure 3:
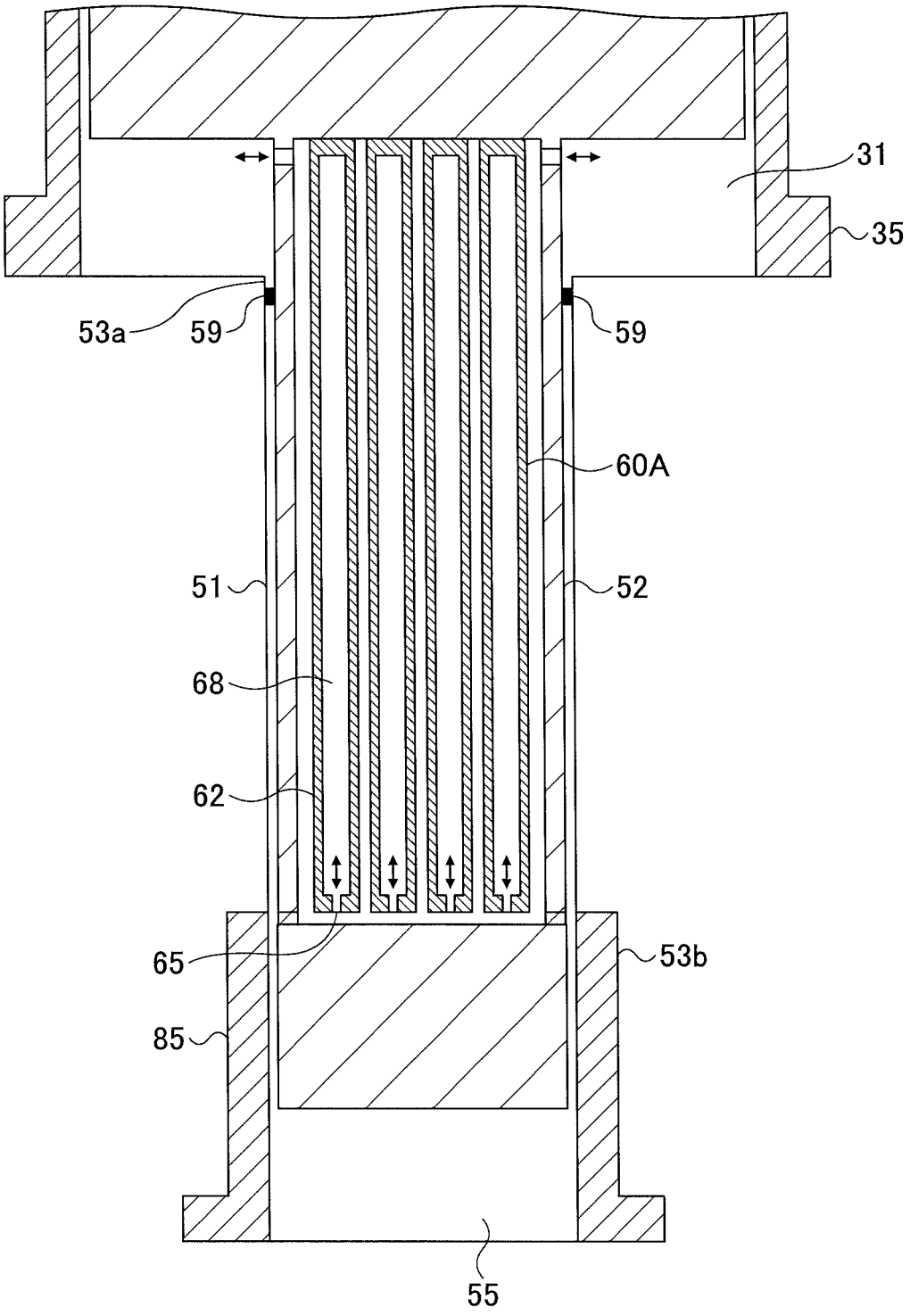
FIG.3 RELATED ART
FIG. 3 is a schematic diagram illustrating a configuration of a conventional helium-cooling type regenerator.

FIG. 3 is a schematic diagram illustrating a configuration of a conventional helium-cooling type regenerator 60A along with members on its periphery. The helium-cooling type regenerator 60A is used as the second-stage regenerator 60 of the GM refrigerator 1 illustrated in FIG. 2. In FIG. 3, the same members as those in FIG. 2 are referred to by the same reference numerals as in FIG. 2.

As illustrated in FIG. 3, the conventional helium-cooling type regenerator 60A is used as a second-stage regenerator in the second-stage displacer 52 illustrated in FIG. 2.

The helium-cooling type regenerator 60A includes multiple containers 62. Each of these containers 62 has an elongated bar shape, and is elongated (extends) along the vertical directions of the regenerator 60A (that is, for example, along the second-stage cylinder 51 in a direction from its high-temperature end 53*a* to its low-temperature end 53*b*). Each of the containers 62 has a hole 65 formed at its end on the low-temperature end 53*b* side of the second-stage cylinder 51. Helium gas 68 serving as a regenerator material is present in the containers 62.

In general, helium gas is higher in specific heat than magnetic materials such as $HoCu_2$ around 10 K. Using helium gas as a regenerator material makes it possible to more efficiently cool working gas (helium gas) flowing through the regenerator 60A.

However, according to the regenerator 60A of the above-described configuration, the helium gas 68, which is also working gas, easily flows into and out of the containers 62 through the holes 65 provided in the containers 62. When such inflow and outflow of the helium gas 68 into and from the containers 62 frequently occur, a greater variation is caused in the pressure of the helium gas 68 working as a regenerator material in the containers 62. Further, this destabilizes the temperature of the helium gas 68, which is a regenerator material, thus making it difficult for the regenerator 60A to maintain stable regeneration performance.

In order to solve these problems, according to an aspect of the present invention, a helium-cooling type regenerator includes a first section through which working gas flows and a second section that stores helium gas as a regenerator material, and the second section is connected to a regenerator material pipe connected to a helium source. According to this regenerator, when the pressure of helium gas decreases in the second section, high-pressure helium gas is introduced into the second section through the regenerator material pipe so as to compensate for the decrease in the pressure of helium gas. Therefore, according to the helium-cooling type regenerator of the aspect of the present invention, it is possible to reduce or eliminate such a problem of the pressure variation and associated temperature instability of a regenerator material (helium gas) in a container as in the conventional helium-cooling type regenerator 60A.

A description is given below, with reference to the accompanying drawings, embodiments of the present invention.

Figure 4:
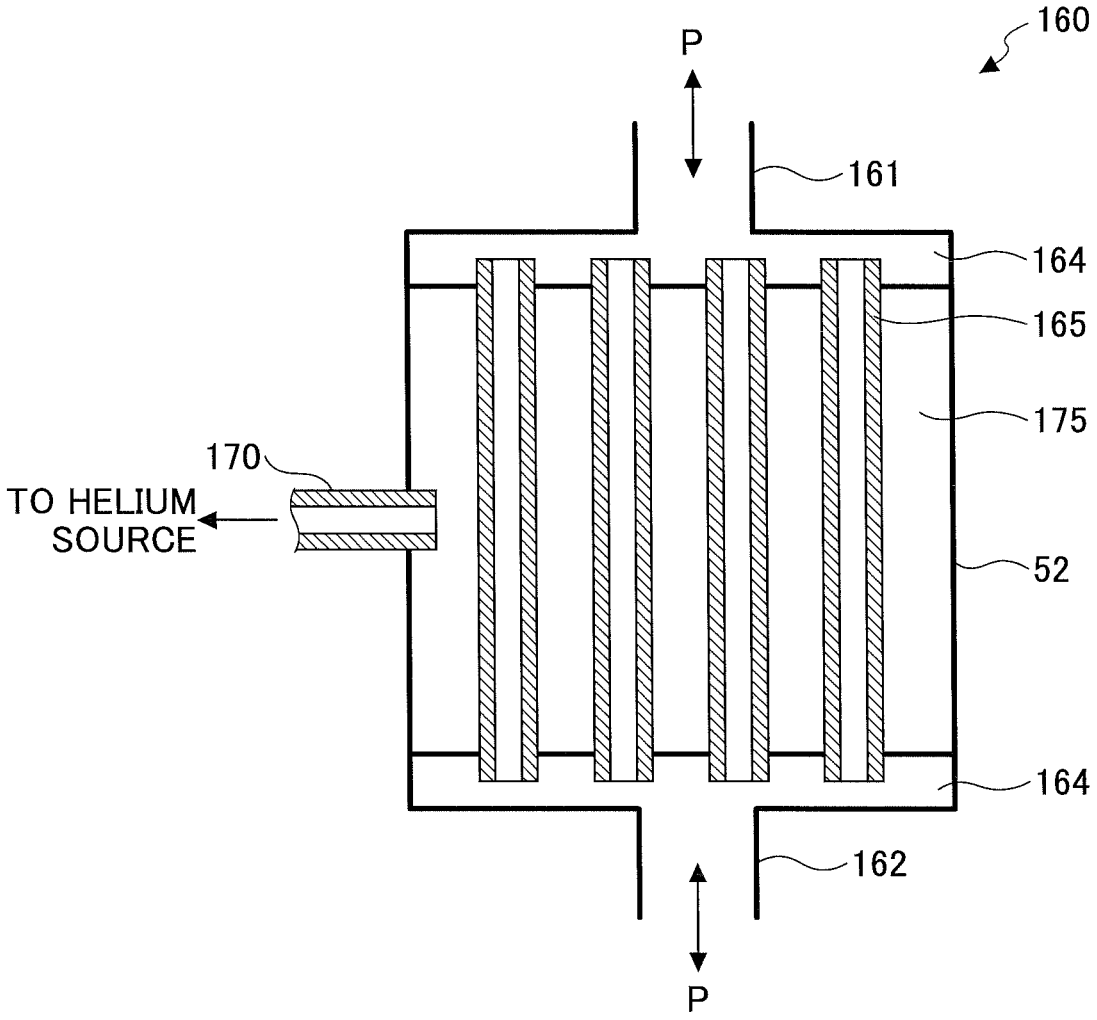
FIG. 4 is a schematic cross-section view of a helium-cooling type regenerator, illustrating a configuration thereof, according to an embodiment of the present invention.

FIG. 4 is a diagram illustrating a helium-cooling type regenerator according to an embodiment of the present invention.

As illustrated in FIG. 4, a helium-cooling type regenerator 160 according to this embodiment may be provided in, for example, the second-stage displacer 52 of the above-described GM refrigerator 1 (FIG. 2).

The regenerator 160 includes multiple hollow tubes 165 and a space part 175. The space part 175 corresponds to a region where the hollow tubes 165 are absent in the regenerator 160. The positions of the hollow tubes 165 are fixed by upper and lower flanges 164. The flanges 164 interrupt communication between the space part 175 and the inside of the hollow tubes 165.

In the example of FIG. 4, the inside of the hollow tubes 165 may correspond to a first section of the regenerator 160. Working gas such as helium flows through the hollow tubes 165. Further, in the example of FIG. 4, the space part 175 may correspond to a second section of the regenerator 160. This space part 175 serves as a part that contains (accommodates) helium gas, which is a regenerator material. The regenerator 160 further includes a first passage 161 and a second passage 162 for working gas. The first and second passages 161 and 162 communicate with the first section.

The regenerator 160 further includes a regenerator material pipe 170. The regenerator material pipe 170 has a first end connected to the space part 175 of the regenerator 160, and has a second end connected to a so-called "helium source" (not graphically illustrated).

In its concept, the "helium source" includes any part that stores high-pressure helium gas and/or liquid helium. For example, when the regenerator 160 is used for a regenerator tube of a GM refrigerator, the "helium source" may be a compressor that feeds and collects working gas. Further, when the regenerator 160 is used for a regenerator tube of a pulse tube refrigerator, the "helium source" may be a compressor that feeds and collects working gas or a buffer tank connected to a pulse tube.

According to the regenerator 160 configured as illustrated in FIG. 4, working gas flows along mainstream directions P. That is, working gas enters the first passage 161 and passes through the hollow tubes 165 to be let out (discharged) through the second passage 162, or moves in the reverse direction.

Meanwhile, helium gas regenerator material is introduced into the space part 175 from the helium source through the regenerator material pipe 170. Here, the pressure of the regenerator material inside the space part 175 is substantially equal to the pressure of the helium source immediately after the start of the operation of the regenerator 160. Thereafter, as the temperature inside the regenerator 160 starts to decrease with the operation of the regenerator 160, the pressure of the regenerator material inside the space part 175 decreases with the temperature decrease. However, in response to this pressure decrease, helium gas is supplementally fed from the helium source into the space part 175 through the regenerator material pipe 170. Accordingly, a change in temperature does not cause so great a change in the pressure of the regenerator material inside the space part 175. Therefore, it is possible for the regenerator 160 of this embodiment to maintain stable regeneration performance during its operation.

In the example of FIG. 4, in the regenerator 160, the first section is defined by the first passage 161, the internal spaces of the hollow tubes 165, and the second passage 162, and the second section is defined by the space part 175. That is, working gas flows through the hollow tubes 165, and a regenerator material is accommodated in the spacer part 175. However, according to this embodiment, the regenerator 160 is not limited to this configuration. For example, the first section and the second section may be opposite to the configuration of FIG. 4. That is, a regenerator may be formed by accommodating a regenerator material inside the hollow tubes 165 and causing working gas to flow through the space part 175. In this case, the regenerator material tube 170 is connected to the hollow tubes 165.

Further, in the example of FIG. 4, the inside of the regenerator 160 is divided into two sections by the inside of the hollow tubes 165 and the space part 175. Alternatively, however, a regenerator may be divided into two sections by other methods. For example, the inside of a regenerator may be divided by a container having an internal space and a space part around the container.

In the above description, a description is given of configurations and their effects according to the embodiment of the present invention, taking, as an example, a case where a regenerator material inside a regenerator is composed of helium gas alone. According to embodiments of the present invention, a regenerator material in a regenerator may be composed of multiple regenerator materials. For example, it is possible to use a $HoCu_2$ magnetic material on the high-temperature side and helium on the intermediate and low-temperature side in a single regenerator. It is also possible to further use a magnetic material such as $Gd_2O_2S$ as a third regenerator material on the yet lower-temperature side.

A helium-cooling type regenerator according to embodiments of the present invention may be applied to various kinds of regenerative refrigerators such as GM refrigerators and pulse tube refrigerators. A description is given below of a configuration of a regenerative refrigerator to which a helium-cooling type regenerator may be applied according to an embodiment of the present invention.

Figure 5:
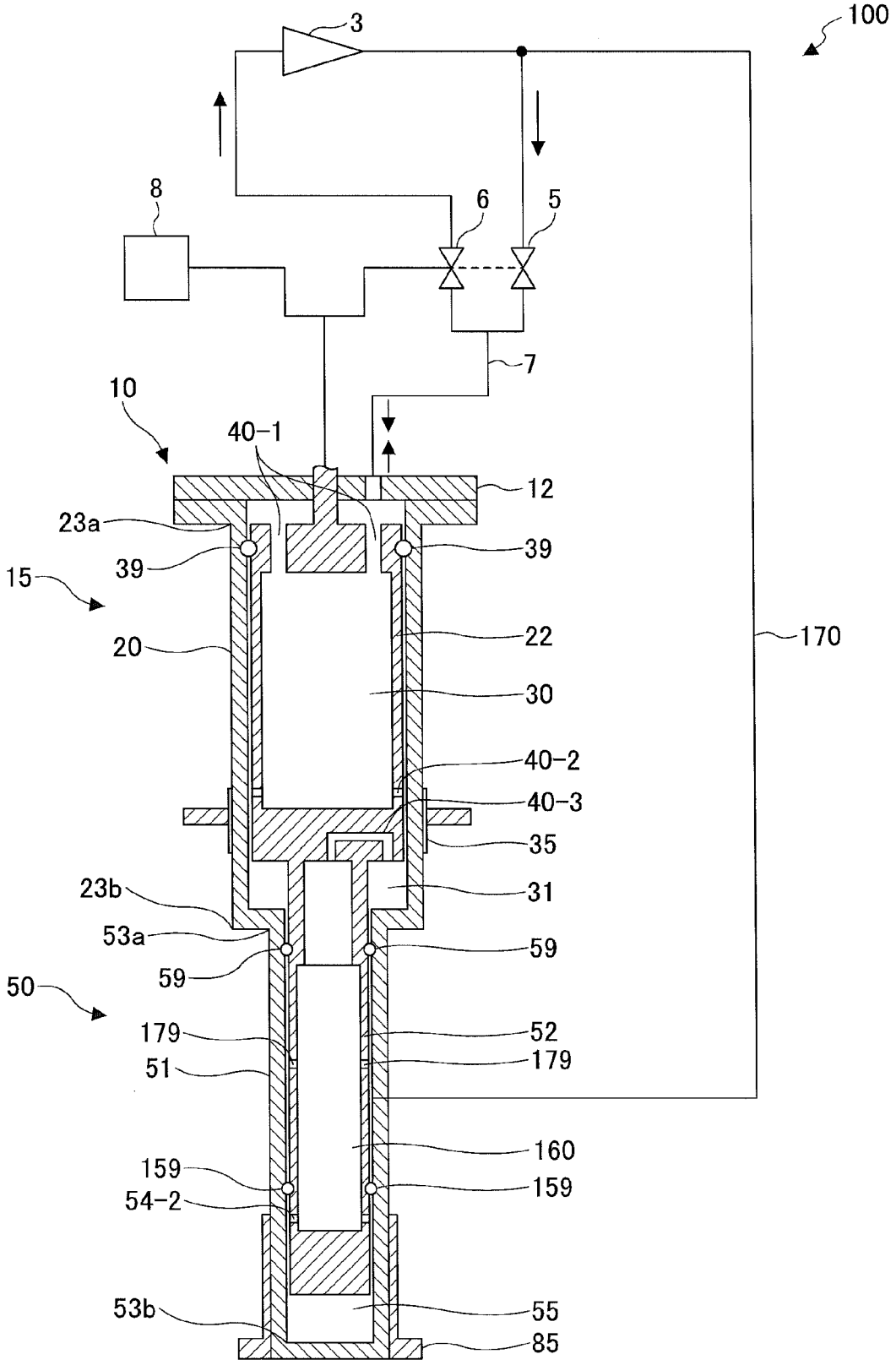
FIG. 5 is a diagram illustrating a configuration of a GM refrigerator including a regenerator according to an embodiment of the present invention.

FIG. 5 is a diagram illustrating a configuration of a GM refrigerator 100 including the regenerator 160 according to an embodiment of the present invention. The GM refrigerator 100 has the same basic configuration as the GM refrigerator 1 illustrated in FIG. 2, and accordingly, the basic configuration of the GM refrigerator 100 is not described in detail below. Further, in the GM refrigerator 100, the same members as those of the GM refrigerator 1 illustrated in FIG. 2 are referred to by the same reference numerals as in FIG. 2.

The GM refrigerator 100 includes the regenerator 160 of the above-described embodiment inside the second-stage displacer 52. Further, according to this embodiment, the second-stage cylinder 51 is connected to the high-pressure side of the compressor 3 through the regenerator material pipe 170 (FIG. 4). Accordingly, the gap between the second-stage cylinder 51 and the second-stage displacer 52 communicates with the regenerator material pipe 170. Further, the second-stage displacer 52 is provided with small holes 179. A space containing a regenerator material inside the regenerator 160 (the space part 175 in FIG. 4) and the gap communicate with each other through these small holes 179. An additional seal 159 is provided in this gap. This additional seal 159 prevents a regenerator material flowing through the regenerator material tube 170 from mixing with working gas.

When the temperature of the regenerator 160 decreases so that the pressure of the space part 175 containing a regenerator material inside the regenerator 160 decreases during the operation of the GM refrigerator 100, helium gas is fed from the compressor 3 into the space part 175 through the regenerator material pipe 170. Accordingly, as described above, the regenerator material inside the regenerator 160 is less likely to be subject to a great pressure change so that it is possible for the regenerator material to maintain stable regeneration performance during the operation of the regenerator 160. Accordingly, it is possible for the GM refrigerator 100 of this embodiment to stably produce cold temperatures in the second-stage cooling stage 85.

Here, the compressor 3, which may be a common compressor, includes an internal bypass valve for releasing pressure. Accordingly, when the pressure increases inside the space part 175 and the regenerator material pipe 170 of the regenerator 160 at the time of stoppage of the GM refrigerator 100, this bypass valve starts to operate to allow a generator material to flow from the high-pressure side to the low-pressure side inside the compressor 3. Therefore, according to the GM refrigerator 100 of this embodiment, no member for releasing a high-pressure regenerator material is newly required in particular in the regenerator 160.

In the example of FIG. 5, the regenerator material pipe 170 is connected to the high-pressure side of the compressor 3. Alternatively, the regenerator material pipe 170 may be connected to the low-pressure side of the compressor 3.

Figure 6:
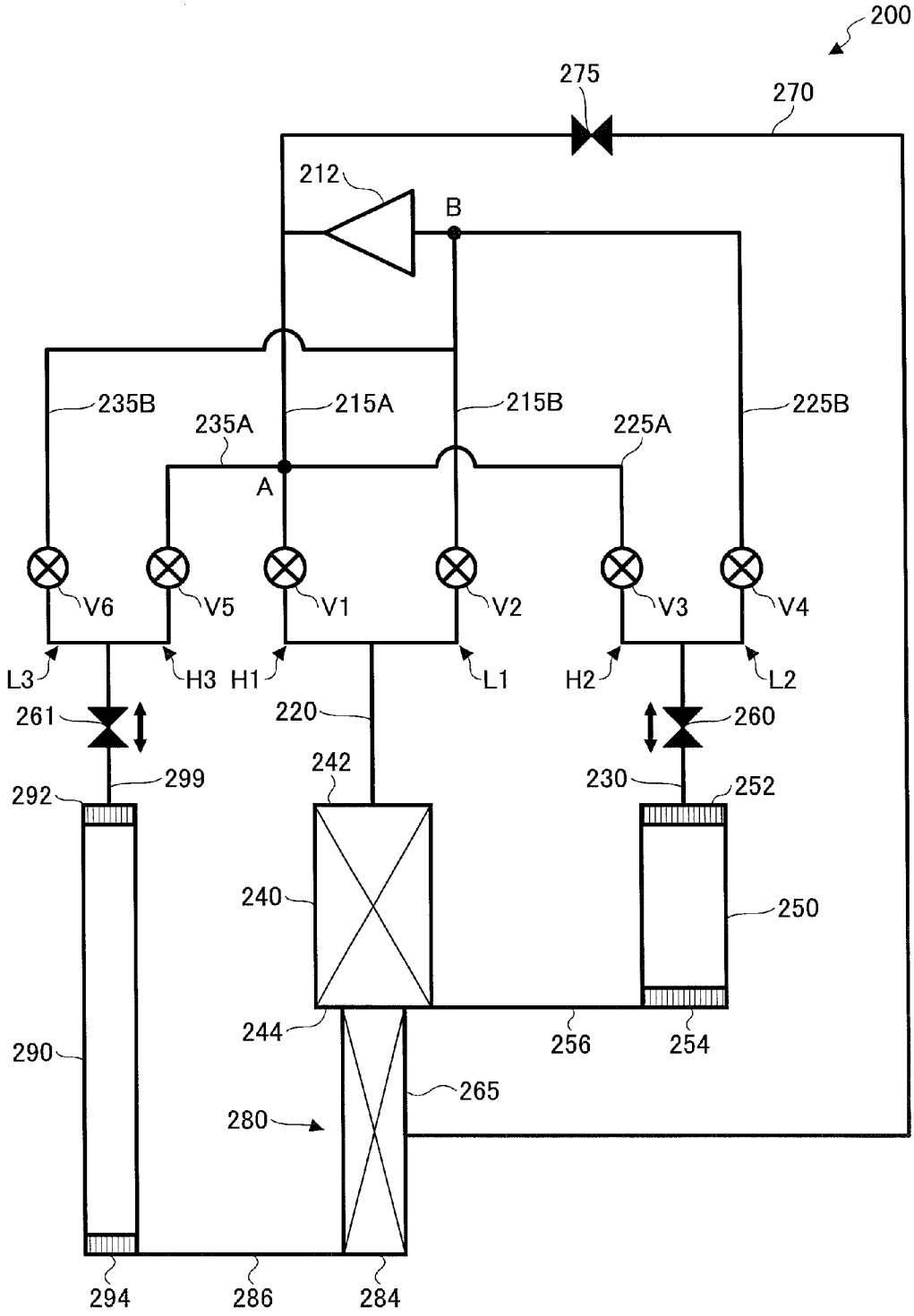
FIG. 6 is a diagram illustrating a configuration of a pulse tube refrigerator including a regenerator according to an embodiment of the present invention.

FIG. 6 is a diagram illustrating a configuration of a pulse tube refrigerator including a regenerator according to an embodiment of the present invention.

As illustrated in FIG. 6, a pulse tube refrigerator 200 is a two-stage pulse tube refrigerator.

The pulse tube refrigerator 200 includes a compressor 212, a first-stage regenerator tube 240, a second-stage regenerator tube 280, a first-stage pulse tube 250, a second-stage pulse tube 290, a first pipe 256, a second pipe 286, an orifice 260, an orifice 261, and opening and closing valves V1, V2, V3, V4, V5 and V6.

The first-stage regenerator tube 240 includes a high-temperature end 242 and a low-temperature end 244. The second-stage regenerator tube 280 includes the high-temperature end 244 (corresponding to the low-temperature end 244 of the first-stage regenerator tube 240) and a low-temperature end 284. The first-stage pulse tube 250 includes a high-temperature end 252 and a low-temperature end 254. The second-stage pulse tube 290 includes a high-temperature end 292 and a low-temperature end 294. Heat exchangers are provided at the high-temperature ends 252 and 292 and the low-temperature ends 254 and 294 of the first-stage and second-stage pulse tubes 250 and 290. The low-temperature end 244 of the first-stage regenerator tube 240 is connected to the low-temperature end 254 of the first-stage pulse tube 250 via the first pipe 256. Further, the low-temperature end 284 of the second-stage regenerator tube 280 is connected to the low-temperature end 294 of the second-stage pulse tube 290 via the second pipe 286.

A refrigerant passage on the high-pressure side (the outlet or discharge side) of the compressor 212 branches off in three directions at Point A. First, second, and third refrigerant feed channels H1, H2, and H3 are formed in these three directions, respectively. The first refrigerant feed channel H1 forms a channel that connects the high-pressure side of the compressor 212, a first high-pressure-side pipe 215A provided with the opening and closing valve V1, a common pipe 220, and the first-stage regenerator tube 240. The second refrigerant feed channel H2 forms a channel that connects the high-pressure side of the compressor 212, a second high-pressure-side pipe 225A provided with the opening and closing valve V3, a common pipe 230 provided with the orifice 260, and the first-stage pulse tube 250. The third refrigerant feed channel H3 forms a channel that connects the high-pressure side of the compressor 212, a third high-pressure-side pipe 235A provided with the opening and closing valve V5, a common pipe 299 provided with the orifice 261, and the second-stage pulse tube 290.

A refrigerant passage on the low-pressure side (the intake or collection side) of the compressor 212 branches off in three directions into first, second, and third refrigerant collection channels L1, L2, and L3. The first refrigerant collection channel L1 forms a channel that connects the first-stage regenerator tube 240, the common pipe 220, a first low-pressure-side pipe 215B provided with the opening and closing valve V2, Point B, and the compressor 212. The second refrigerant collection channel L2 forms a channel that connects the first-stage pulse tube 250, the common pipe 230 provided with the orifice 260, a second low-pressure-side pipe 225B provided with the opening and closing valve V4, Point B, and the compressor 212. The third refrigerant collection channel L3 forms a channel that connects the second-stage pulse tube 290, the common pipe 299 provided with the orifice 261, a third low-pressure-side pipe 235B provided with the opening and closing valve V6, Point B, and the compressor 212.

A general principle of operation of the pulse tube refrigerator 200 having this configuration is known to a person having ordinary skill in the art, and accordingly, a description of the principle of operation of the pulse tube refrigerator 200 is omitted.

According to the pulse tube refrigerator 200 of this embodiment, a regenerator 265 having the same configuration as the regenerator 160 illustrated in FIG. 4 is provided in the second-stage regenerator tube 280. Further, a space part containing a regenerator material inside the regenerator 265 is connected to the high-pressure side of the compressor 212 via a regenerator material pipe 270 including a flow resistance 275. The flow resistance 275 may be omitted.

According to this embodiment, when the temperature of the regenerator 265 decreases so that the pressure of the space part containing a regenerator material inside the regenerator 265 decreases during the operation of the pulse tube refrigerator 200, helium gas is fed into the space part from the compressor 212 through the regenerator material pipe 270. As a result, as described above, the regenerator material inside the regenerator 265 is less likely to be subject to a great pressure change so that it is possible for the regenerator material to maintain stable regeneration performance during the operation of the regenerator 265. Accordingly, it is possible for the pulse tube refrigerator 200 as well to stably produce cold temperatures at the low-temperature end 294 of the second-stage pulse tube 290.

In the example of FIG. 6, the regenerator material pipe 270 may include another flow resistance such as a valve between the regenerator 265 and the compressor 212. In this case, it is possible to control the flow rate of helium gas fed into the space part of the regenerator 265 containing a regenerator material during the operation of the pulse tube refrigerator 200.

Further, in the example of FIG. 6, the regenerator material pipe 270 is connected to the high-pressure side of the compressor 212. Alternatively, the regenerator material tube 270 may be connected to the low-pressure side of the compressor 212.

Figure 7:
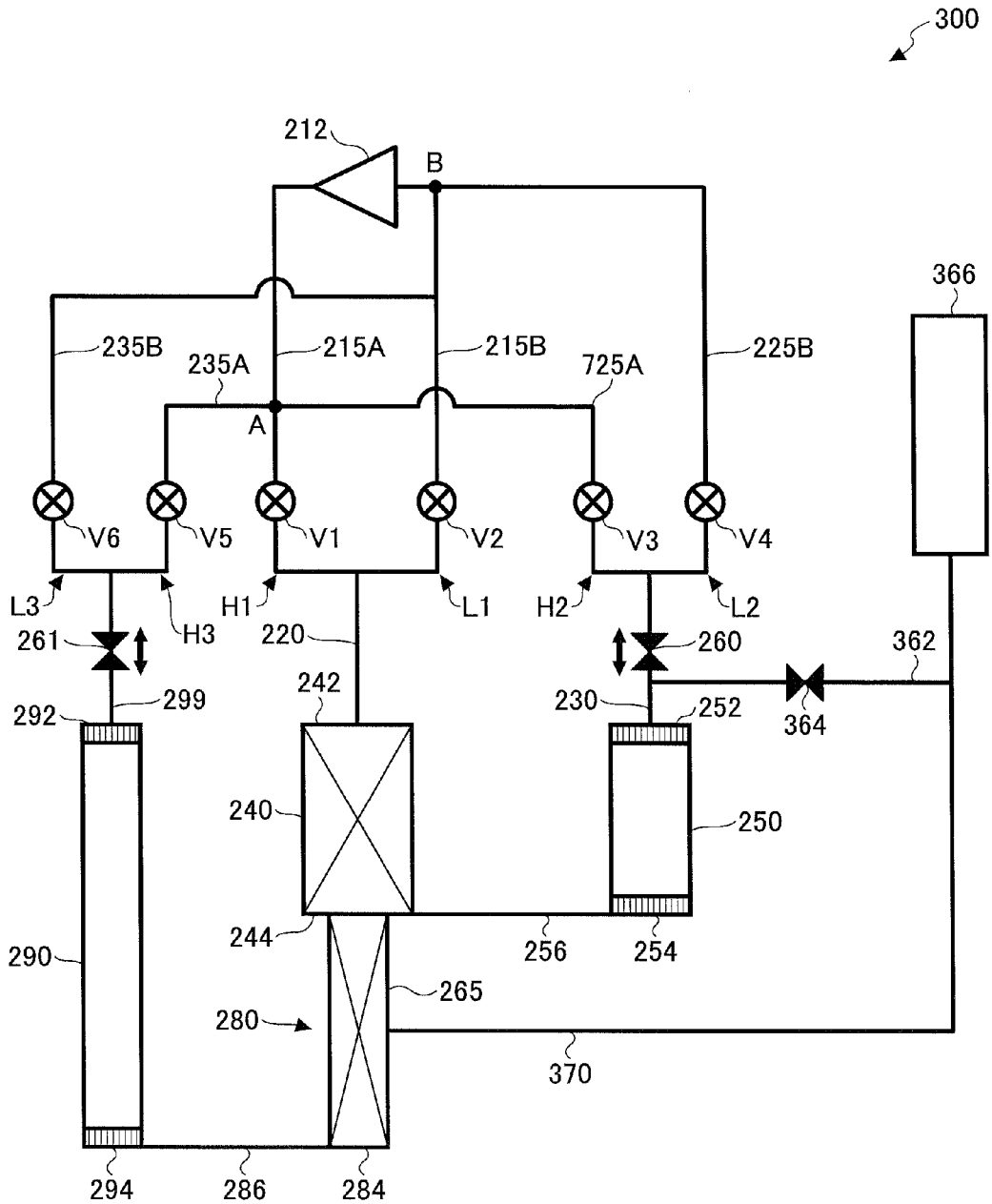
FIG. 7 is a diagram illustrating a configuration of a pulse tube refrigerator including a regenerator according to an embodiment of the present invention.

FIG. 7 is a diagram illustrating a configuration of a pulse tube refrigerator including a regenerator according to another embodiment of the present invention.

A pulse tube refrigerator 300 illustrated in FIG. 7 basically has substantially the same configuration as the pulse tube refrigerator 200 illustrated in FIG. 6. In FIG. 7, the same members as those illustrated in FIG. 6 are referred to by the same reference numerals as in FIG. 6.

According to this embodiment, the pulse tube refrigerator 300 includes a buffer tank 366. The buffer tank 366 is connected to the high-temperature end 252 of the first-stage pulse tube 250 via a pipe 362 including an orifice 364. According to the pulse tube refrigerator 300, the regenerator 265 having the same configuration as the regenerator 160 illustrated in FIG. 4 is connected to the buffer tank, instead of the compressor 212, through a regenerator material pipe 370.

According to this embodiment, when the temperature of the regenerator 265 decreases so that the pressure of the space part containing a regenerator material inside the regenerator 265 decreases during the operation of the pulse tube refrigerator 300, helium gas is fed into the space part containing a regenerator material from the buffer tank 366 through the regenerator material pipe 370. As a result, as described above, the regenerator material inside the regenerator 265 is less likely to be subject to a great pressure change so that it is possible for the regenerator material to maintain stable regeneration performance during the operation of the regenerator 265. Accordingly, it is possible for the pulse tube refrigerator 300 as well to stably produce cold temperatures at the low-temperature end 294 of the second-stage pulse tube 290.

Figure 8:
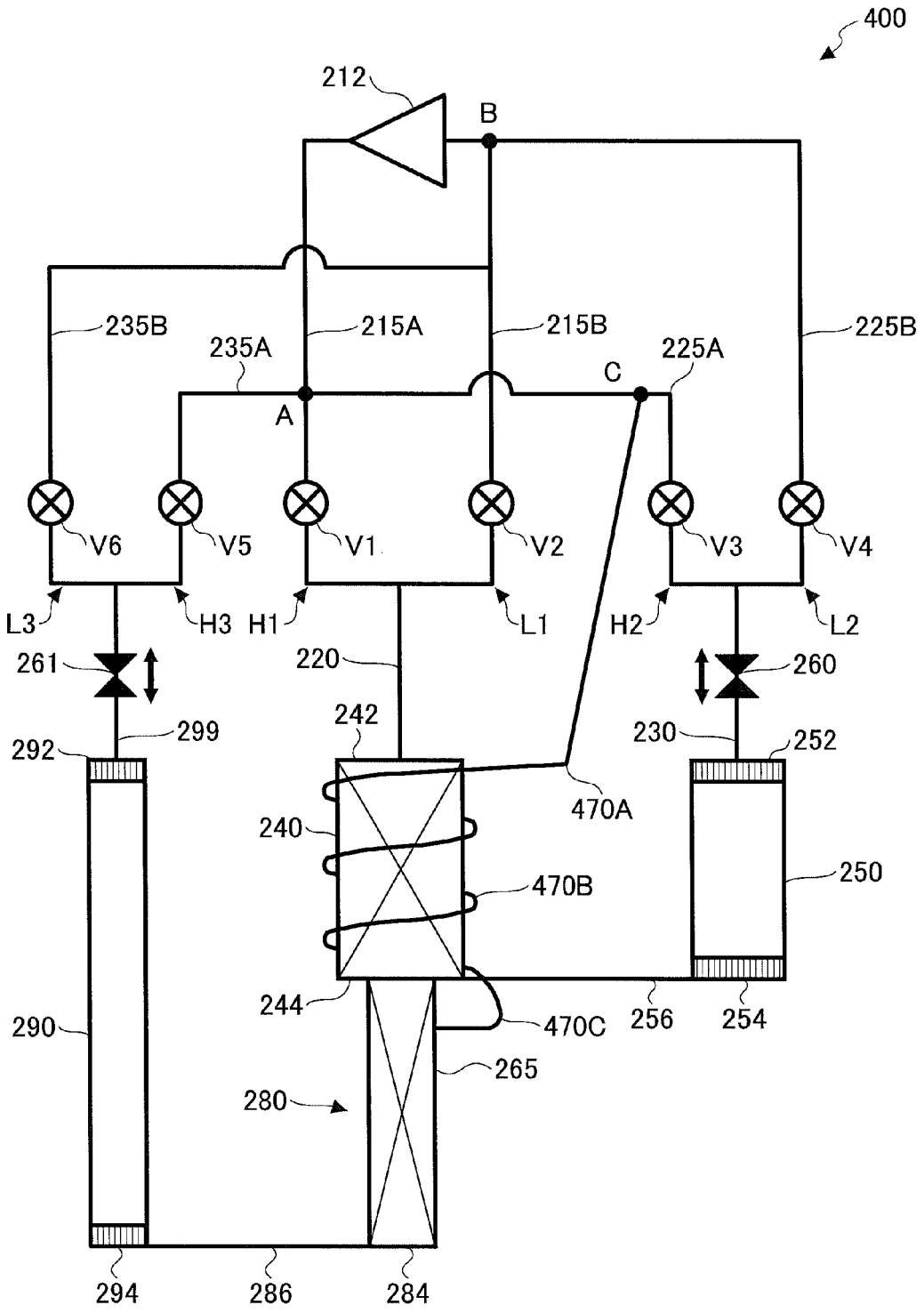
FIG. 8 is a diagram illustrating a configuration of a pulse tube refrigerator including a regenerator according to an embodiment of the present invention.

FIG. 8 is a diagram illustrating a configuration of a pulse tube refrigerator including a regenerator according to yet another embodiment of the present invention.

A pulse tube refrigerator 400 illustrated in FIG. 8 basically has substantially the same configuration as the pulse tube refrigerator 200 illustrated in FIG. 6. In FIG. 8, the same members as those illustrated in FIG. 6 are referred to by the same reference numerals as in FIG. 6.

According to this embodiment, the pulse tube refrigerator 400 includes a regenerator material pipe 470 that connects a second section (a space containing a regenerator material) inside the regenerator 265 provided in the second-stage regenerator tube 280 to the high-pressure side of the compressor 212.

The regenerator material pipe 470 includes a first part 470A, a second part 470B, and a third part 470C. The first part 470A of the regenerator material pipe 470 is connected to the high-pressure side of the compressor 212. For example, in the example of FIG. 8, the first part 470A is connected to the second high-pressure-side pipe 225A at Point C. Further, the second part 470B of the regenerator material pipe 470 is provided around the first-stage regenerator tube 240. Further, the third part 470C of the regenerator material pipe 470 is connected to the regenerator 265 of the second-stage regenerator tube 280.

According to this configuration, during the operation of the pulse tube refrigerator 400, when the temperature of the regenerator 265 decreases so that the pressure of the space part containing a regenerator material inside the regenerator 265 decreases, helium gas flows from the compressor 212 to the third part 470C of the regenerator material tube 470 through the second high-pressure-side pipe 225A. This helium gas is pre-cooled by the first-stage regenerator tube 240 when passing through the second part 470B of the regenerator material pipe 470. Accordingly, the pre-cooled helium gas is introduced into the regenerator 265 of the second-stage regenerator tube 280 through the third part 470C of the regenerator material pipe 470. Therefore, according to this configuration, it is possible to more effectively control a possible temperature increase caused by the introduction of a regenerator gas into the regenerator 265.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A pulse tube refrigerator, comprising:

a compressor configured to feed working gas to a pulse tube via a regenerator tube and to collect the working gas from the pulse tube via the regenerator tube; and a helium-cooling type regenerator configured to retain cold temperatures of the working gas, the helium-cooling type regenerator including a first section through which helium gas serving as the working gas flows; and a second section configured to accommodate the helium gas serving as a regenerator material, the second section and the compressor connected by a regenerator material pipe, the regenerator material pipe configured to provide the regenerator material from the compressor to the second section, wherein fluid communication between the first and second section is interrupted, wherein the helium-cooling type regenerator is provided in the regenerator tube.

2. The pulse tube refrigerator as claimed in claim 1, wherein the regenerator tube includes a first-stage regenerator tube on a first side and a second-stage regenerator tube on a second side lower in temperature than the first side, and the helium-cooling type regenerator is provided in the second-stage regenerator tube.

3. The pulse tube refrigerator as claimed in claim 2, wherein the helium gas introduced into the regenerator material pipe as the regenerator material is pre-cooled by the first-stage regenerator tube.

4. The pulse tube refrigerator as claimed in claim 1, wherein one of the first section and the second section is defined by an internal space inside a plurality of hollow tubes.

5. The pulse tube refrigerator as claimed in claim 4, wherein the hollow tubes are elongated in a direction from a high-temperature end to a low-temperature end of the helium-cooling type regenerator.

6. The pulse tube refrigerator as claimed in claim 1, wherein pre-cooled helium gas is introduced into the regenerator material pipe as the regenerator material.

* * * * *